United States Patent [19]

Tsutsumi et al.

[11] Patent Number: 4,869,658

[45] Date of Patent: Sep. 26, 1989

[54] PREVENTION AGAINST SHIFTING OF TIP SEAL OF SCROLL COMPRESSOR

[75] Inventors: Sadao Tsutsumi, Yokohama; Kazuaki Sato, Tokyo, both of Japan

[73] Assignee: Iwata Air Compressor Manufacturing Company Limited, Japan

[21] Appl. No.: 159,662

[22] Filed: Feb. 24, 1988

[30] Foreign Application Priority Data

Feb. 27, 1987 [JP] Japan ..... 62-27348[U]

[51] Int. Cl.[4] ..... F04C 18/04; F04C 27/00; F16J 9/24

[52] U.S. Cl. ..... 418/55; 418/142; 277/136; 277/181; 277/189; 277/204

[58] Field of Search ..... 418/55, 142; 277/136, 277/181, 189, 204

[56] References Cited

U.S. PATENT DOCUMENTS

| | | | |
|---|---|---|---|
| 1,572,443 | 2/1926 | Muchnic | 277/136 |
| 2,006,972 | 7/1935 | Vincent et al. | 277/136 |
| 3,976,406 | 8/1976 | Sasaki | 418/142 |
| 3,976,407 | 8/1976 | Gerlach | 418/142 |
| 4,199,308 | 4/1980 | McCullough | 418/55 |
| 4,367,702 | 1/1983 | Lassanske | 277/136 |
| 4,627,799 | 12/1986 | Terauchi | 418/55 |
| 4,730,375 | 3/1988 | Nakamura et al. | 418/55 |

FOREIGN PATENT DOCUMENTS

| | | | |
|---|---|---|---|
| 431488 | 7/1935 | United Kingdom | 277/136 |

*Primary Examiner*—John J. Vrablik

*Attorney, Agent, or Firm*—Gifford, Groh, Sheridan, Sprinkle and Dolgorukov

[57] ABSTRACT

A prevention against shifting of tip seal of a scroll compressor with a pair of stationary scroll and swirl scroll provided with spiral laps projectingly on an inside of end plates engaged with each other for sucking in a gas from a suction port and discharging a compressed gas from a discharge port, wherein a tip seal groove is formed on the laps provided projectingly on said pair of scrolls, a tip seal is disposed in the tip seal groove, which comprises providing a fixing means for preventing a discharge port side end portion of the tip seal disposed in said tip seal groove from shifting to a suction port side from a discharge port side along said tip seal groove, thereby preventing a leakage of a lap nose on the discharge port side.

7 Claims, 8 Drawing Sheets

PREVENTION AGAINST SHIFTING OF TIP SEAL OF SCROLL COMPRESSOR

BACKGROUND OF THE INVENTION

1. Field of the Invention

The present invention relates to a prevention against shifting of a tip seal mounted on a scroll compressor.

2. Description of the Prior Art

A prior art given in FIG. 10 to FIG. 12 is known as common in this kind of apparatus.

In the drawings, 1 denotes a stationary scroll, 1*a* denotes an end plate of the stationary scroll 1, 1*b* denotes a lap formed vertically and swirlingly on an inside 1*c* of the end plate 1*a*, 2 denotes a swirl scroll provided opposite to the stationary scroll 1, 2*a* denotes an end plate of the swirl scroll 2, 2*b* denotes a lap formed vertically and swirlingly on an inside 2*c* of the end plate 2*a*, and an arrangement is such that the scrolls 1, 2 are paired to face each other, the laps 1*b* and 2*b* are then engaged with each other, the stationary scroll 1 is fixed on a frame 3, and the swirl scroll 2 is swirled on an eccentric part 4*a* of a crankshaft 4 or a driving shaft. A reference numeral 5 denotes a needle bearing, the crankshaft 4 is supported on bearings 6, 7 fixed on the frame 3, 8 denotes a balance weight mounted on the crankshaft 4, 9 denotes a suction port of air or a gas to compress which is provided on the stationary scroll 1, and 10 denotes a discharge port of a compressed air. A reference numeral 11 denotes a tip seal, which is made, for example, of an elastic material having a self-lubricating efficiency and formed swirlingly. A reference numeral 12 denotes a nose portion of the tip seal 11, 13 denotes a spiral tip seal groove provided on the nose portion 12 longitudinally of the laps 1*b*, 2*b*, and the tip seal 11 is fitted in the tip seal groove 13. A reference character 13*a* denotes a bottom portion of the groove 13.

A reference numeral 15 denotes an oil feed port for feeding oil to the bearings for lubrication and cooling. The frame 3 is mounted in such manner as will cover the scrolls 1, 2 so as not to allow a lubricting oil fed from the oil feed port 15 to leak externally.

In consideration of an elongation due to thermal expansion, the tip seal 11 is shortened by l from the length of the tip seal groove 13. A reference character 11*a* denotes a discharge port side end portion of the tip seal 11, and 11*b* denotes a suction port side end portion of the tip seal 11.

In the above-described construction, a gas pocket P working as a compression chamber is formed between the the laps 1*b*, 2*b* mated to face each other and the end plates 1*a*, 2*a* by facing the stationary scroll 1 and the swirl scroll 2 provided projectingly from the end plates 1*a*, 2*a* respectively each other, the air is sucked in from the suction port 9 by moving the swirl scroll 2 round a central axis of the stationary scroll 1, and a compressed air is discharged into the gas pocket P (FIG. 3) formed according as the swirl scroll 2 is moved as above from the discharge port 10.

In the tip seal of a prior art scroll compressor, the construction is such that the tip seal 11 is fitted in the nose portion 12 of the laps 1*b*, 2*b* of the stationary scroll 1 and the swirl scroll 2, and both the scrolls 1, 2 are kept facing each other, then the nose portion 12 of the tip seal 11 is pressed onto the insides 1*c*, 2*c* of the end plates 1*a*, 2*a* of both the scrolls 1, 2, thereby preventing leakage from the nose portion 12 of the laps 1*b*, 2*b*.

However, in the prior art scroll compressor, since the tip seal 11 is kept shorter in length than the tip seal groove 13 in consideration of an elongation due to temperature rise arising according to an operation of the compressor, the tip seal 11 contracts due to a temperature drop or a discharge pressure applied on a discharge side end portion of the tip seal 11 and moves from the side of discharge port 10 to the side of suction port 9 along the tip seal groove 13, thus leaving a suction side end portion of the tip seal crushed. Thus, the tip seal will never revert from the contraction despite an actuation of the compressor to temperature rise. Consequently, the tip seal is not present on the side of discharge port 10, and a sealing between the gas pocket on a high pressure side and the gas pocket on a low pressure side cannot be realized at a nose of the laps 1*a*, 1*b*.

SUMMARY OF THE INVENTION

The invention has been done to settle the problem pointed out as above, and its object is to provide a prevention against shifting of tip seal of a scroll compressor, which comprises a fixing means for preventing the discharge port side end portion of a tip seal disposed in a tip seal groove from shifting to a suction port side from a discharge port side along the tip seal groove, thereby preventing a leakage of a lap nose on the discharge port side.

Now, therefore, in a prevention against shifting of tip seal of a scroll compressor relating to the invention, a fixing means for regulating a shift of the discharge port side end portion of a tip seal disposed in a tip seal groove formed on a lap from a discharge port side to a suction port side along the tip seal groove is provided, therefore a leakage of a lap nose on the discharge port side can be prevented to attain the aforementioned object.

According to such construction, since a shift of the discharge port side end portion of the tip seal disposed in the tip seal groove from a discharge port side to a suction port side in the tip seal groove is regulated, a leakage of the lap nose on the discharge port side can be prevented effectively.

DETAILED DESCRIPTION OF PREFERRED EMBODIMENTS

Figure 1:
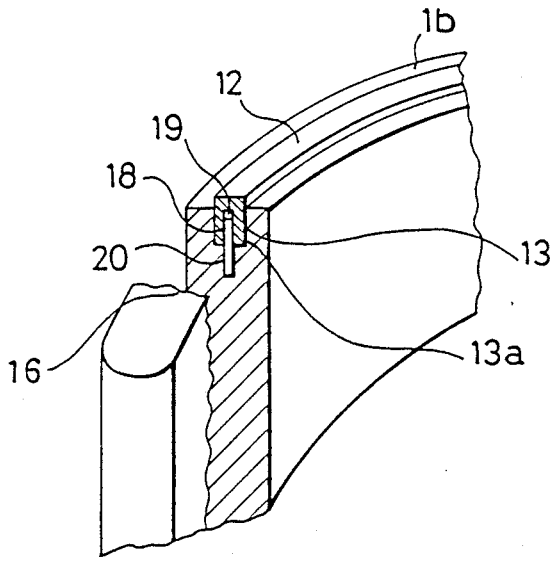
FIG. 1 is a longitudinal sectional view of a prevention against shifting of tip seal of a scroll compressor given in one embodiment of the invention.

One embodiment of a prevention against shifting of tip seal of a scroll compressor relating to the invention will now be described with reference to FIG. 1 to FIG. 4.

Reference characters 1 to 15 represent the parts like or corresponding to the prior art one, for which no further description will be given repeatedly hereunder.

Figure 2:
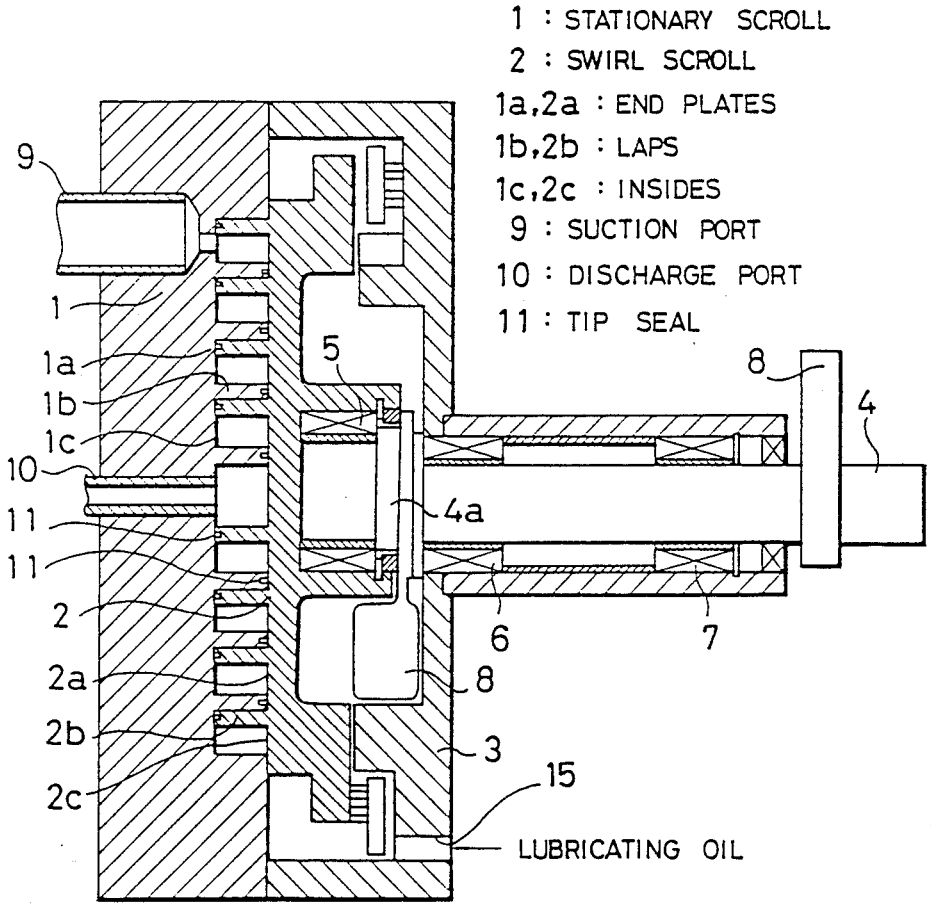
FIG. 2 is a front sectional view of a scroll compressor using the prevention against shifting of tip seal.
Figure 3:
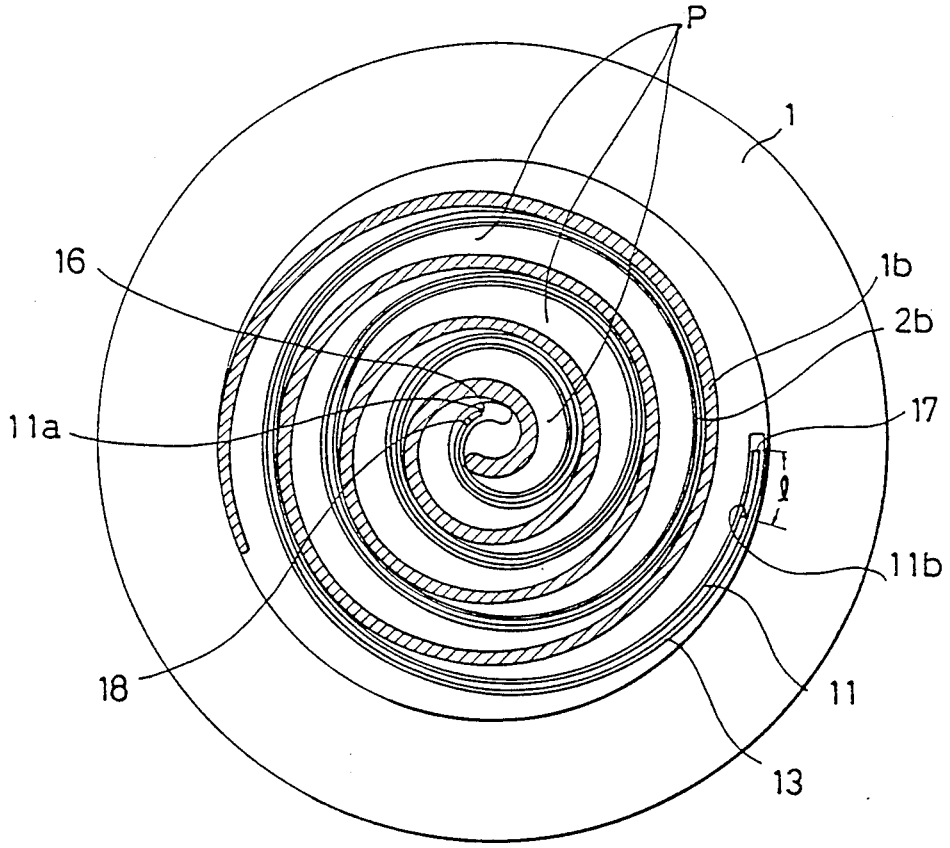
FIG. 3 is a side sectional view of the scroll.
Figure 4:
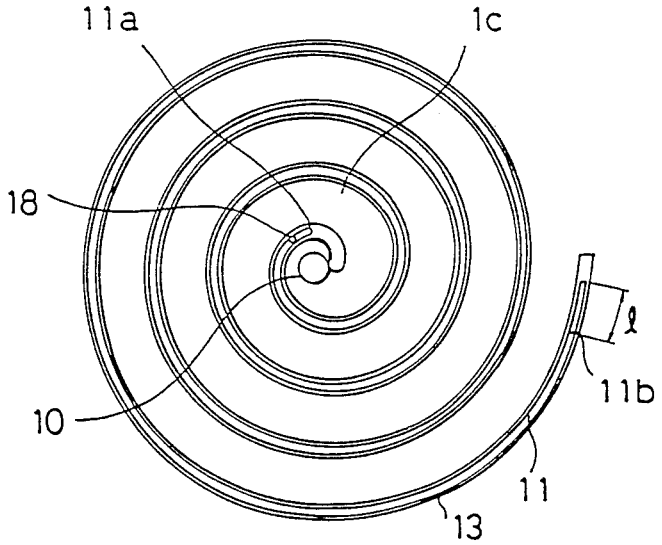
FIG. 4 is a side view showing a state wherein the tip seal is disposed in a tip seal groove.

FIG. 1 is a longitudinal sectional view of a prevention against shifting of tip seal of a scroll compressor which is given in one embodiment of the invention; FIG. 2 is a front sectional view of a scroll compressor to which the prevention against shifting of tip seal given in one embodiment of the invention is applied; FIG. 3 is a side sectional view of the scroll; FIG. 4 is a side view showing a state wherein the tip seal is disposed in a tip seal groove.

A reference numeral 16 denotes a discharge port side end portion of the tip seal groove 13, and 17 denotes a suction port side end portion thereof. A reference numeral 18 denotes a pin for preventing the discharge port side end portion 11*a* of the tip seal 11 from shifting to a suction port side from a discharge port side along the tip seal groove 13 in the state where the tip seal 11 is disposed in the tip seal groove 13, and 19, 20 denote pin holes for fitting the pin 18 therein, of which the pin hole 19 is perforated in the tip seal 11, while the pin hole 20 is perforated in the bottom portion 13*a* of the lap 13.

According to the above-described construction, the gas pocket working as a compression chamber will be constructed by the laps 1*b*, 2*b* and the insides 1*c*, 2*c* of the end plate 1*a*, 2*a* from facing both the scrolls 1, 2 each other, therefore when the crank-shaft 4 is rotated, the swirl scroll 2 revolves round a center line of the stationary scroll 1 to suck in a gas or air, for example, from the suction port 9, and a compressed air is discharged from the discharge port 10 provided at a central portion of the stationary scroll 1.

In this case, temperature of both the scrolls 1, 2 rises according to a temperature rise of the compressed air, and the tip seal 11 disposed in the tip seal groove 13 formed on the laps 1*b*, 2*b* of the scrolls 1, 2 expands on heat. The tip seal 11 contracts by temperature drop or discharge pressure applied on a discharge side end portion of the tip seal at the time of shutdown of the scroll compressor, shifts from the side of discharge port 10 to the side of suction port 9 along the tip seal groove, and thus a suction side end portion of the tip seal is left crushed. Consequently, the tip seal will not revert from the contraction despite restart-up of the compressor to temperature rise. Further, since the contraction of the tip seal 11 begins from the suction port side end portion 11*b*, the discharge port side end portion 11*a* of the tip seal 11 shifts toward the suction port side end portion along the tip seal groove 13.

The tip seal 11 of this kind is made shorter in length than the tip seal groove 13 by an elongation l due to thermal expansion, therefore it will never come out of the tip seal groove 13 despite elongation due to thermal expansion.

However, there takes place a clearance between the insides 1*c*, 2*c* of the end plates 1*a*, 2*a* of both the scrolls 1, 2 and athe bottom portion 13*a* of the tip seal groove 13 by a space whereat the nose portion 12 of the laps 1*b*, 2*b* on the discharge port side shifts to the suction port side of the tip seal 11 from the discharge port side end portion 11*a* of the tip seal 11 disposed in the tip seal groove 13 shifting to the suction port side from the discharge port side, thus allowing a compressed air of high pressure to leak a low-pressure side therefrom. The leakage may deteriorate a compression efficiency of the scroll compressor and thus is to exert a big influence, needless to say, on a performance of this kind of apparatus.

In one embodiment of the invention, since the tip seal 11 has the pin 18 fitted in the bottom portion 13*a* of the laps 1*b*, 2*b* through the pin hole 20 perforated in the tip seal groove 13 at the discharge side end portion 11*a*, the discharge port side end portion 11*a* of the tip seal 11 will never shift to the suction port side, and no clearance will result from the shifting, therefore a leakage at the nose portion 12 of the laps 1*b*, 2*b* can be prevented.

According to the prevention against shifting of tip seal of a scroll compressor given in one embodiment of the invention, the tip seal is pinned on a bottom portion of the tip seal groove at the discharge port side end portion so as not to allow the discharge port side end portion of the tip seal disposed in the tip seal groove formed on the laps to shift from the discharge port side to the suction side along the tip seal groove, therefore the discharge port side end portion of the tip seal is controlled for shifting from an area on the discharge port side to the suction port side due to thermal contraction, force based on a pressure difference to work on the tip seal end portions on the discharge port side and the suction port side, centrifugal force due to a swirling action of the swirl scroll and so forth, and a leakage from a high-pressure side to a low-pressure side can be prevented at a lap nose on the discharge port side.

According to one embodiment of the invention, furthermore, there is an effect ensured such that a prevention against shifting of tip seal of a scroll compressor may be obtained at a moderate cost through a simple structure.

Figure 5:
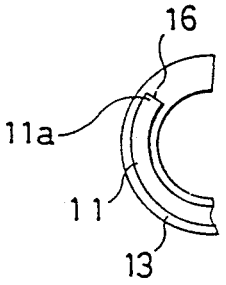
FIG. 5 to FIG. 9*b* are explanatory drawings of other embodiments of the invention.

In one embodiment of the invention, the pin holes 19, 20 are provided on the tip seal and the tip seal groove respectively at the discharge port side end portion 11*a* of the tip seal 11, and the discharge port side end portion 11*a* of the tip seal 11 is fixed not to shift to the suction side by fitting the pin 18 slidably up and down in the pin holes 19, 20, however, a similar effect will be obtainable from bonding the discharge port side end portion 11*a* of the tip seal to the bottom portion 13*a* of the tip seal groove 13 as shown in FIG. 5.

Figure 6:
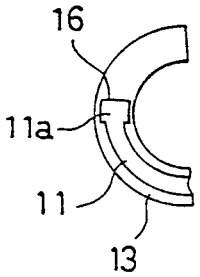
Figure 7:
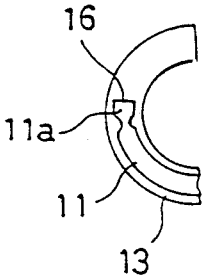

Further, instead of arranging the fixing means given in the aforementioned embodiment, the discharge port side end portion 11*a* of the tip seal 11 and the discharge port side end portion 16 of the tip seal groove 13 may be enlarged and so formed as shown in FIG. 6, or the discharge port side end portions 11*a*, 16 may be contracted partly in section and so formed as a deformed swelling as shown in FIG. 7 with the tip seal force fit therein.

Figure 8A:
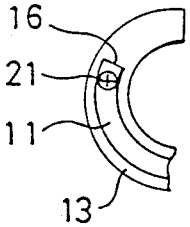
Figure 8B:
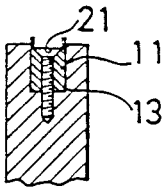

FIG. 8*a* and FIG. 8*b* are a side view and a longitudinal sectional view showing another embodiment each. As shown in the embodiment, a similar effect will be obtainable from locking the discharge port side end portion 11*a* of the tip seal 11 on the bottom portion 13*a* of the tip seal groove 13 with a screw 21 lockable in the through pin hole 20 instead of the pin 18 in the aforementioned one embodiment.

Figure 9A:
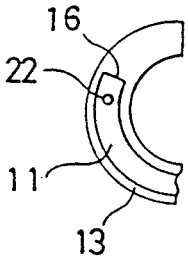
Figure 9B:
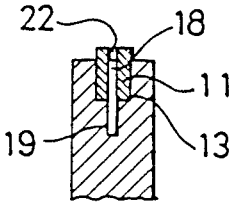
Figure 10:
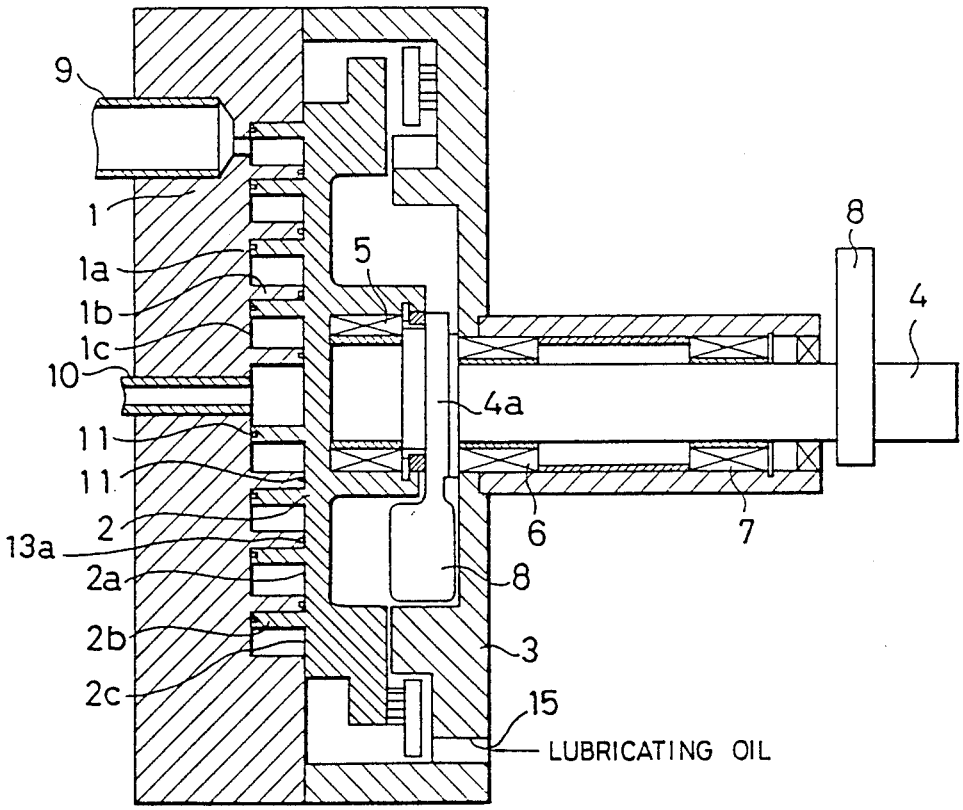
FIG. 10 PRIOR ART
FIG. 10 is a front sectional view of a prior art scroll compressor.
Figure 11:
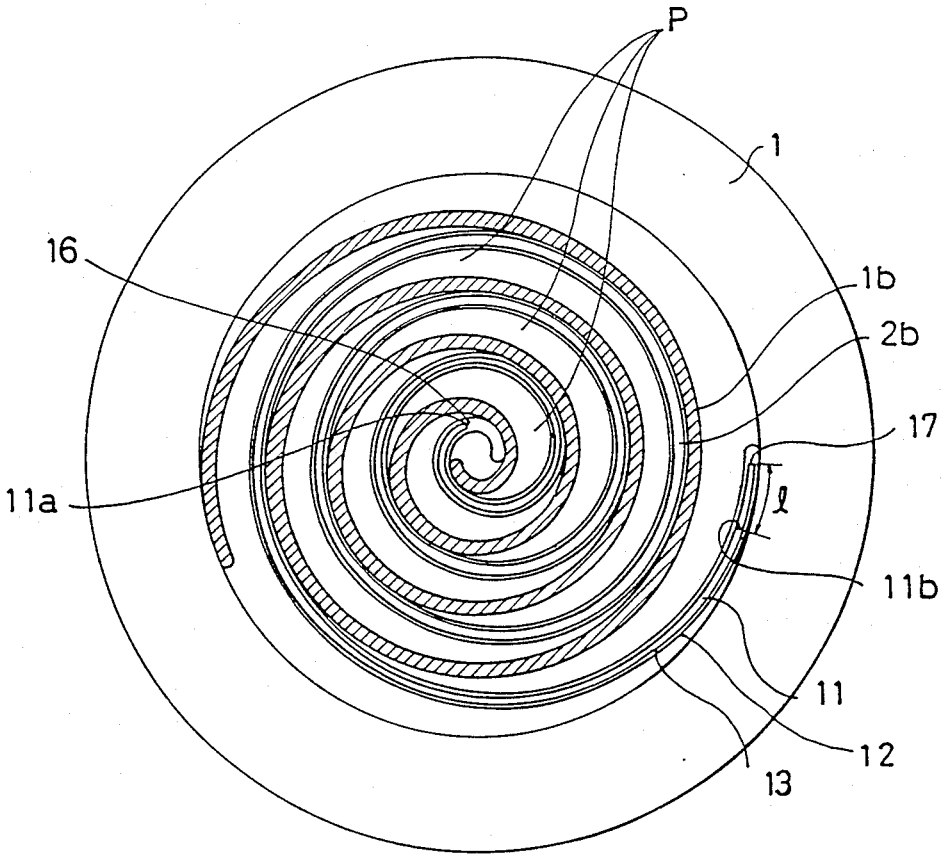
FIG. 11 PRIOR ART
FIG. 11 is a side sectional view of the scroll.
Figure 12:
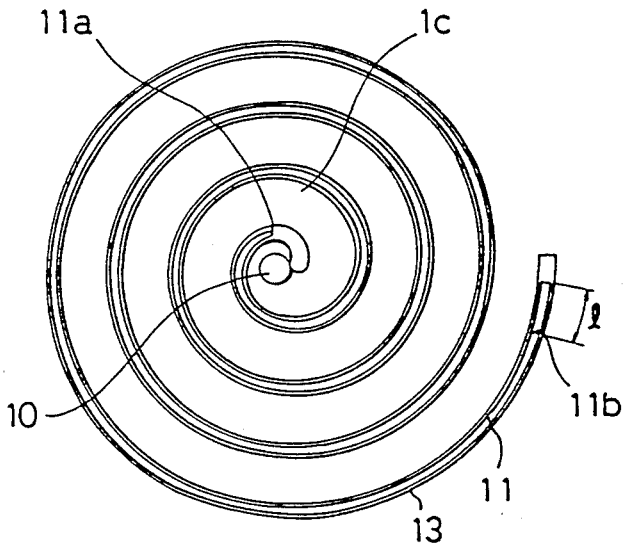
FIG. 12 PRIOR ART
FIG. 12 is a side view showing a state wherein the tip seal is disposed in a tip seal groove.

FIG. 9*a* and FIG. 9*b* are a side view and a longitudinal sectional view showing a further embodiment each. As shown in the embodiment, instead of the blind pin hole 20 representing another embodiment employing the locking means such as screw or the like including the pin in the aforementioned one embodiment, a pin hole 22 is perforated through in the tip seal 11, therefore when the tip seal 11 is disposed in the tip seal groove 13, first the tip seal 11 is fitted in the tip seal groove 13, and then the pin 18 will be inserted in the pin hole 22, thus facilitating the assembling work.

Then, the tip seal is trapezoidal, semicircular or the like in section and hence is not necessarily limited to rectangle. Further, the tip seal may be inserted loosely in the tip seal groove.

As described above, according to the invention, a prevention against shifting of tip seal of a scroll compressor wherein a leakage of the lap nose on a discharged port side is prevented and thus a performance of the scroll compressor can be enhanced may be provided by providing a fixing means so as not to allow a discharge port side end portion of the tip seal disposed in a tip seal groove formed on the lap to shift from the discharge port side to the suction port side along the tip seal groove.

What is claimed is:

1. In a scroll compressor of the type having a suction port, a discharge port, a stationary scroll and a swirl scroll, both provided with spiral laps for engaging end plates during rotation to receive a gas from said suction port, compress said gas, and discharge said compressed gas through said discharge port, the improvement including:

(a) a tip seal groove provided proximate to the middle of said spiral laps and having a discharge port end and a suction port end, (b) a tip seal disposed in said tip seal groove, said tip seal being shorter than said tip seal groove to provide for expansion, and (c) means provided in said tip seal groove only proximate said discharge port end to prevent shifting of said tip seal only at said discharge port end.

2. The device defined in claim 1, wherein said means to prevent shifting include:

(a) a pin hole provided in the bottom of said tip seal groove, (b) a complimentary blind pin hole provided in said tip seal, and (c) a pin slidably fitted in said pin hole, said pin being engaged by said blind pin hole in said tip seal.

3. The device defined in claim 1, wherein said means to prevent shifting include bonding said tip seal in said tip seal groove.

4. The device defined in claim 1, wherein said means to prevent shifting include:

(a) an enlarged portion being provided in said tip seal at the discharge port end, and (b) an enlarged portion being provided in said tip seal groove proximate the discharge port end, with said enlarged portion of said tip seal engaging said enlarged portion of said tip seal groove.

5. The device defined in claim 1, wherein said means to prevent shifting include:

(a) a contracted portion being provided in said tip seal groove proximate said discharge port end, and (b) said tip seal being force fit into said contracted portion and retained thereby.

6. The device defined in claim 1, wherein said means to prevent shifting include:

(a) a screw hole provided in the bottom of said tip seal groove proximate said discharge port end, (b) a complimentary hole provided in said tip seal, and (c) a screw being passed completely through said screw hole in said tip seal and engaging said screw hole in said tip seal groove.

7. The device defined in claim 1, wherein said means to prevent shifting include:

(a) a pin hole provided in the bottom of said tip seal groove proximate said discharge port end, (b) a complimentary pin hole provided in said tip seal, and (c) a pin slidably fitted in said pin hole in said tip seal groove and engaging said pin hole in said tip seal.

* * * * *